US005878317A

United States Patent [19]

Masuda et al.

[11] Patent Number: 5,878,317

[45] Date of Patent: Mar. 2, 1999

[54] ELECTROPHOTOGRAPHIC METHOD AND APPARATUS INCLUDING A TONER RECYCLE FEATURE

[75] Inventors: Katsumi Masuda, Tokyo-to; Takaya Muraishi, Yokohama; Masato Yokoyama, Tokyo-to; Masumi Sato; Toshiyuki Uchida, both of Yokohama, all of Japan

[73] Assignee: Ricoh Company, Ltd., Tokyo, Japan

[21] Appl. No.: 969,013

[22] Filed: Nov. 12, 1997

[30] Foreign Application Priority Data

Nov. 11, 1996 [JP] Japan ..... 8-314227
Jul. 2, 1997 [JP] Japan ..... 9-191798

[51] Int. Cl.[6] ..... G03G 21/00

[52] U.S. Cl. ..... 399/359; 399/120; 430/125

[58] Field of Search ..... 399/110, 111, 399/119, 120, 125, 359, 312; 430/125

[56] References Cited

U.S. PATENT DOCUMENTS

| | | | |
|---|---|---|---|
| 4,768,055 | 8/1988 | Takamatsu et al. | 399/111 X |
| 5,012,286 | 4/1991 | Kawano et al. | 399/59 |
| 5,126,799 | 6/1992 | Matsuura et al. | 399/110 |
| 5,128,724 | 7/1992 | Hayashi et al. | 399/119 |
| 5,153,653 | 10/1992 | Fuma et al. | 399/312 |
| 5,194,050 | 3/1993 | Muraishi et al. | 474/101 |
| 5,321,483 | 6/1994 | Yokoyama et al. | 399/351 |
| 5,419,468 | 5/1995 | Taki | 399/119 X |
| 5,541,714 | 7/1996 | Watanabe et al. | 399/120 |
| 5,592,267 | 1/1997 | Misago et al. | 399/359 X |
| 5,734,957 | 3/1998 | Ogawa et al. | 399/359 |

FOREIGN PATENT DOCUMENTS

| | | |
|---|---|---|
| 55-73078 (A) | 6/1980 | Japan . |
| 62-26762 (Y2) | 7/1987 | Japan . |
| 62-36226 (B2) | 8/1987 | Japan . |
| 06-110329 | 4/1994 | Japan . |

*Primary Examiner*—Arthur T. Grimley
*Assistant Examiner*—Sophia S. Chen
*Attorney, Agent, or Firm*—Oblon, Spivak, McClelland, Maier & Neustadt, P.C.

[57] ABSTRACT

An electrophotographic method and apparatus includes a frame having a used toner inlet, a new toner inlet and a combined toner outlet. Opposing sides of the frame are positioned at predetermined angles with respect to a horizontal line extending from a bottom of the frame. The used toner inlet is positioned in an upper portion of the frame next on one of the sides positioned at a predetermined angle, while the new toner inlet is also positioned in the upper portion of the frame, but next to the other side. The predetermined angle of the frame's side that is next to the used toner inlet is at a greater angle than the other side so as to compensate for any degradation in the flow characteristic of the used toner as a result of the recycling process. The frame is configured to interface with a new toner bottle having an opening that cooperates with the new toner inlet. Accordingly, when the new toner supply is exhausted, the new toner bottle may easily be replaced without having to remove any other components.

21 Claims, 5 Drawing Sheets

ELECTROPHOTOGRAPHIC METHOD AND APPARATUS INCLUDING A TONER RECYCLE FEATURE

CROSS REFERENCE TO RELATED APPLICATIONS

The present application contains subject matter related to that disclosed in Ser. No. 07/619,508, filed Nov. 29, 1990, now U.S. Pat. No. 5,126,799; Ser. No. 07/782,126, filed Oct. 25, 1991, now U.S. Pat. No. 5,194,050; Ser. No. 07/914,598, filed Jul. 20, 1992, now U.S. Pat. No. 5,321,483; and Ser. No. 08/007,787, filed Jan. 22, 1993, now U.S. Pat. No. 5,329,340, the contents of which are incorporated herein by reference.

BACKGROUND OF THE INVENTION

1. Field of the Invention

The present invention relates to an electrophotographic method and apparatus such as that employed in a photocopy machine, a facsimile machine, a printer, and a multi functional machine capable of recording an image on a sheet of paper or other image recording medium.

2. Discussion of the Background

In a typical electrophotographic apparatus, 5–20% of a toner, or other image forming substance, used in the electrophotographic process remains on a photosensitive medium, such as a photosensitive drum or belt, without being transferred to the recording medium. In order to preserve the purity of subsequent image forming operations, this residual toner must then be removed and recovered by a cleaning device, otherwise the residual toner will make the next copy appear to be "dirty". The residual toner (i.e., the used toner) exhibits different characteristics than the new toner in that the residual toner does not flow as well as a result of being rubbed and deformed by the cleaning device. That is to say, the used toner has attributes that differ from new toner such that the used toner does not share the same flow characteristics as new toner, and thus, does not reliably reproduce images when recycled and handled in the same way as new toner.

Due to this difference in flow characteristics, many conventional devices simply discard the used toner. Certainly, this approach of discarding 5 to 20% of the total toner, rather than recycling the same, is a much less environmentally friendly process than other devices that recycle the used toner.

FIG. 1 shows a device that recycles toner, where the device is discussed in Japanese Granted Utility Model Application No. 62-26762. FIG. 1 shows a charging device 2, developing device 3, transferring device 4, and cleaning device 5 arranged around a photosensitive medium (i.e., drum 1). The cleaning device 5 is connected to the developing device 3 via a conveyance pipe 6 and a toner conveyance screw 7 is arranged to rotate within the conveyance pipe 6 so as to move the used toner therethrough. As a result, the used toner is recycled by being transported from the cleaning device 5 into the developing device 3 by rotation of the toner conveyance screw 7.

FIG. 2 shows another conventional apparatus that recycles toner as discussed in Japanese Granted Patent Application No. 62-36226, which corresponds directly with Japanese laid-open Patent Application No. 55-73078. In the apparatus of FIG. 2, a charging device 102, developing device 103, transferring device 104, and cleaning device 105 are arranged around a photosensitive medium 101. A used toner conveyance pipe 106 is rotatably installed in the developing device 103, as shown. A pipe connector 108 is installed in the cleaning device 105, as shown, such that used toner from the cleaning device 105 passes to the developing device 103 via the conveyance pipe 106 and the pipe connector 108. In this configuration, the conveyance pipe 106 is arranged horizontally, as noted by a solid line, and thus requires a set of rotatable screws 109 which urge the used toner toward the developing device 103. During a maintenance operation that requires the photosensitive medium 101 to be removed, the pipe connector 108 and conveyance pipe 106 rotate out of the way, as is illustrated by the dashed line in FIG. 2. In this configuration, the conveyance pipe 106 is no longer operable, but sufficient clearance is obtained so that sufficient access is made available for servicing the photosensitive medium 101.

As recognized by the present inventors, a limitation with the apparatus described in Japanese Granted Utility Model Application No. 62-26762 (i.e., the device of FIG. 1) is that it requires the use of an activated conveyance pipe 6 with a conveyance screw 7 therein so as to move the used toner to be added directly to the developer, without first being mixed with new toner. The dedicated conveyance path with the active conveyance screw 7 is costly to manufacture and does not necessarily ensure adequate mixing of the used toner with the new toner.

Similarly, in the device described in Japanese laid-open Patent Application No. 55-73078, the used toner conveyance coil 109 is needed to convey the used toner to the developer because the conveyance path is generally horizontal. This dedicated conveyance path with the active conveyance screw 109 is costly to manufacture and is does not necessarily ensure adequate mixing of the used toner with the new toner.

SUMMARY OF THE INVENTION

Accordingly, one object of this invention is to provide a novel method and apparatus for recycling an image forming substance such as toner that overcomes the above-mentioned limitations of existing methods and systems.

Another object of the invention is to provide an image forming method and apparatus that combines new toner with used toner in predetermined amounts so as to preserve image quality over time.

It is another object of the invention to provide an image forming apparatus that recycles toner and allows a new toner tank to be independently replaced in the apparatus during a maintenance action without also removing a used toner tank or other apparatuses.

It is still another object of the invention to provide an image forming apparatus that recycles toner and mixes new toner and used toner in a frame without requiring any activated components in the frame.

These and other objects may be accomplished with a method and apparatus that includes a frame having a used toner inlet, a new toner inlet and a combined toner outlet. Opposing sides of the frame are positioned at predetermined angles with respect to a horizontal line extending from a bottom of the frame. The used toner inlet is positioned in an upper portion of the frame next on one of the sides positioned at a predetermined angle, while the new toner inlet is also positioned at in the upper portion of the frame, but next to the other side. The predetermined angle of the frame's side that is next to the used toner inlet is at a greater angle than the other side so as to compensate for any degradation in the flow characteristic of the used toner as a result of the recycling process. The frame is configured to interface with a new toner bottle having an opening that cooperates with the new toner inlet. New toner from the new toner bottle enters the frame and is guided toward the combined toner outlet so as to combine with the used toner as the combination enters the developing device. Accordingly, when the new toner supply is exhausted, the new toner bottle may easily be replaced without having to remove other components.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
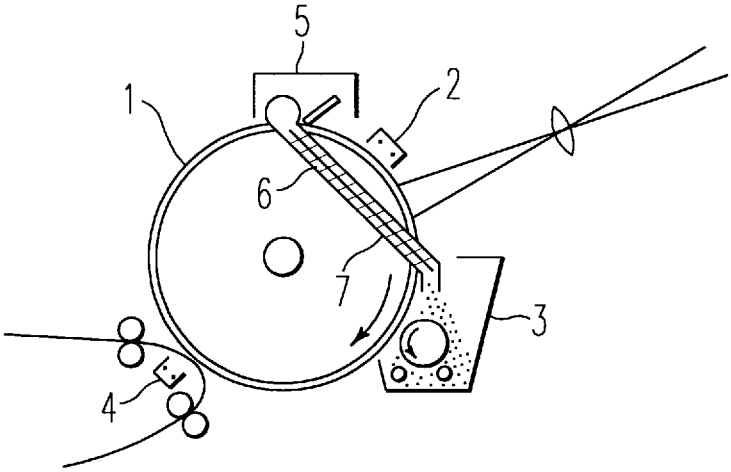
FIG. 1 BACKGROUND ART
FIG. 1 is a side view of a conventional image forming apparatus that recycles toner and employs a dedicated used toner conveyance path.
Figure 2:
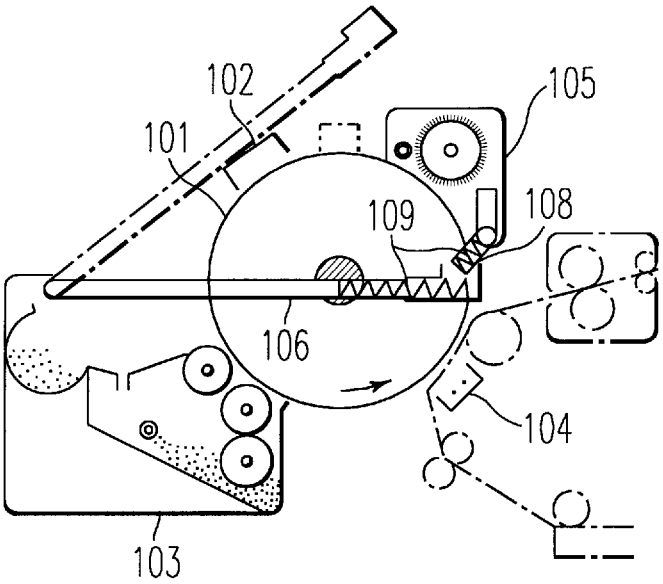
FIG. 2 BACKGROUND ART
FIG. 2 is a side view of another conventional image forming apparatus that recycles toner and employs a dedicated used toner conveyance path that is horizontally positioned in a normal mode of operation.
Figure 3:
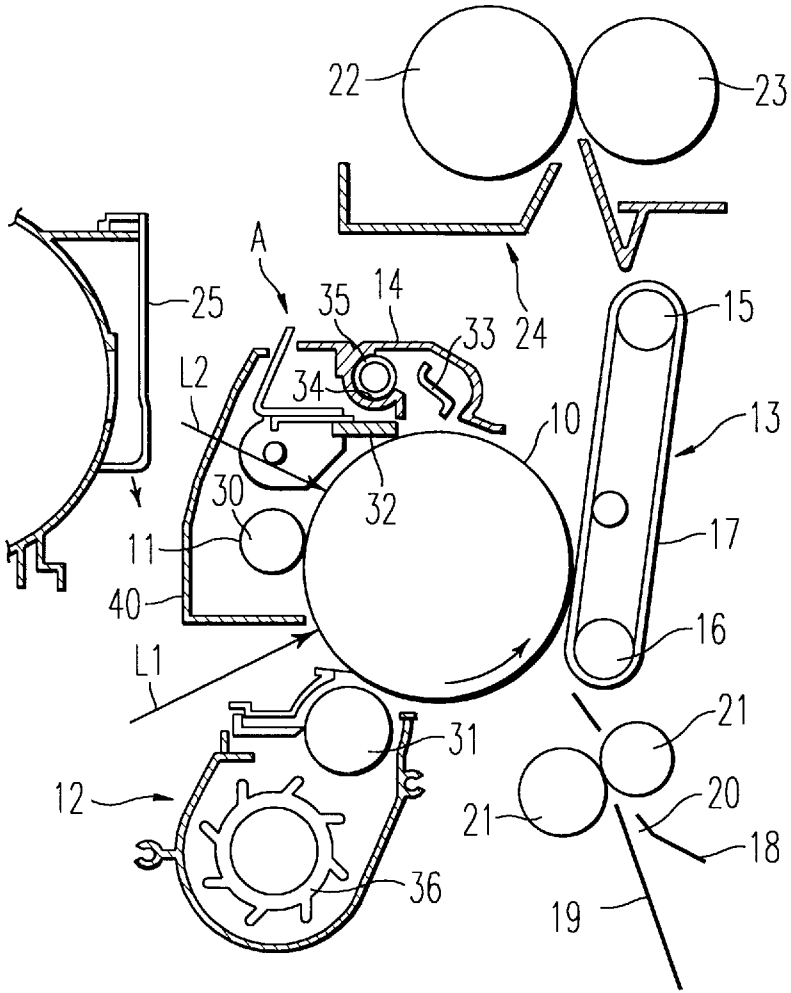
FIG. 3 is a partial schematic representation of an image forming apparatus according to the present invention and which incorporates a toner recycling feature.

Referring now to the drawings, wherein like reference numerals designate identical or corresponding parts throughout the several views, and more particularly to FIG. 3 thereof, there is illustrated an embodiment of the present invention in the form of a laser-beam based electrophotographic copier.

As shown in FIG. 3, a photosensitive device, such as a drum 10, belt or other suitable device, is configured to rotate in a counterclockwise direction as shown by the arrow in FIG. 3. Disposed about the periphery of the drum 10 are selected devices which will be described in sequence. A precharger 11 is located at a left side of the photosensitive drum 10 and is configured to uniformly charge the drum 10 to a predetermined electrical potential. A writing device (not shown) irradiates the photosensitive drum 10 with laser beam L1, as shown, so as to form an electrostatic latent image corresponding to an original image.

A developing device 12 is located downstream of where the latent image is formed. The developing device 12 coats the latent image on the photosensitive drum 10 with toner so as to provide a toner image on the drum 10. Downstream of the developing device 12 is a transferring device 13 that is configured to transfer the toner image to a recording paper (or sheet) and later transfers the paper with the toner image formed thereon to a fixing device 24. Downstream of the transferring device 13 is a cleaning device 14 that cleans (i.e., removes) any residual toner from the drum 10 that was not transferred to the recording paper. This residual (i.e., used) toner is then collected, and mixed with new toner provided from a new toner bottle 25, as will be discussed with respect to FIGS. 4, 5 and 6. In this embodiment, the photosensitive drum 10, the precharger 11, casing 40 and cleaning device 14 form a single body A, referred to as a photosensitive unit A.

Accordingly, specific features of the present embodiment will be discussed in more detail, in the context of how toner is handled during a copying and cleaning operation of the present apparatus. In response to an operator pushing a button that results in an image on an original document being scanned, a charging roller 30 of the precharger 11 uniformly charges the surface of the photosensitive drum 10. The laser beam L1 then exposes portions of the charged surface of the drum 10 so as to create the latent image that corresponds with the original image. The latent image then rotates with the drum 10 to a position opposing the developer 12. A developing sleeve 31 applies toner (new and used toner as will be discussed with respect to FIGS. 4, 5 and 6) to the latent image so as to form a toner image on the drum 10. The new toner and the used toner is conveyed to the sleeve 31 via a rotational paddle 36. The paddle 36 also circulates the toner in the developer 12.

The recording paper is fed from a paper storing section through a paper conveyance path 20 that guides the recording paper toward the transfer device 13. The transferring device 13 includes an upper roller 15, a lower roller 16, and transferring belt 17 stretched between the two rollers 15, 16. A pair of guide parts 18, 19 are arranged so as to reliably feed the transfer paper to the pair of timing rollers 21. The timing rollers 21 feed the paper between the drum 10 and the transfer device 13 so that the transfer device 13 may transfer the toner image from the drum 10 to the paper. An electrical charge transfer device may be included proximate an inner periphery of the belt 17 so as to more completely transfer the toner image.

Once the toner image is transferred to the paper, the transferring belt 17 guides the paper to a fixing device 24, which includes a heat roller 22 and a press roller 23, as shown. When the paper passes between the heat roller 22 and the press roller 23, the toner image becomes fixed to the paper. However, toner that remains on the drum 10 rotates with the drum to the cleaning device 14. In the cleaning device 14, a cleaning blade 32 contacts the photosensitive drum 10, and removes the used toner from the drum. This used toner is then collected by a toner floating wing 33 which pushes the used toner into a toner recovery tank 34. The used toner is conveyed by a screw 35 in a direction that would appear to be into the page in reference to FIG. 3. Subsequently, a ray L2 produced by a lamp, not shown, erases the electrical charge remaining on the photosensitive drum 10. The process then repeats so additional copies can be made.

Figure 4:
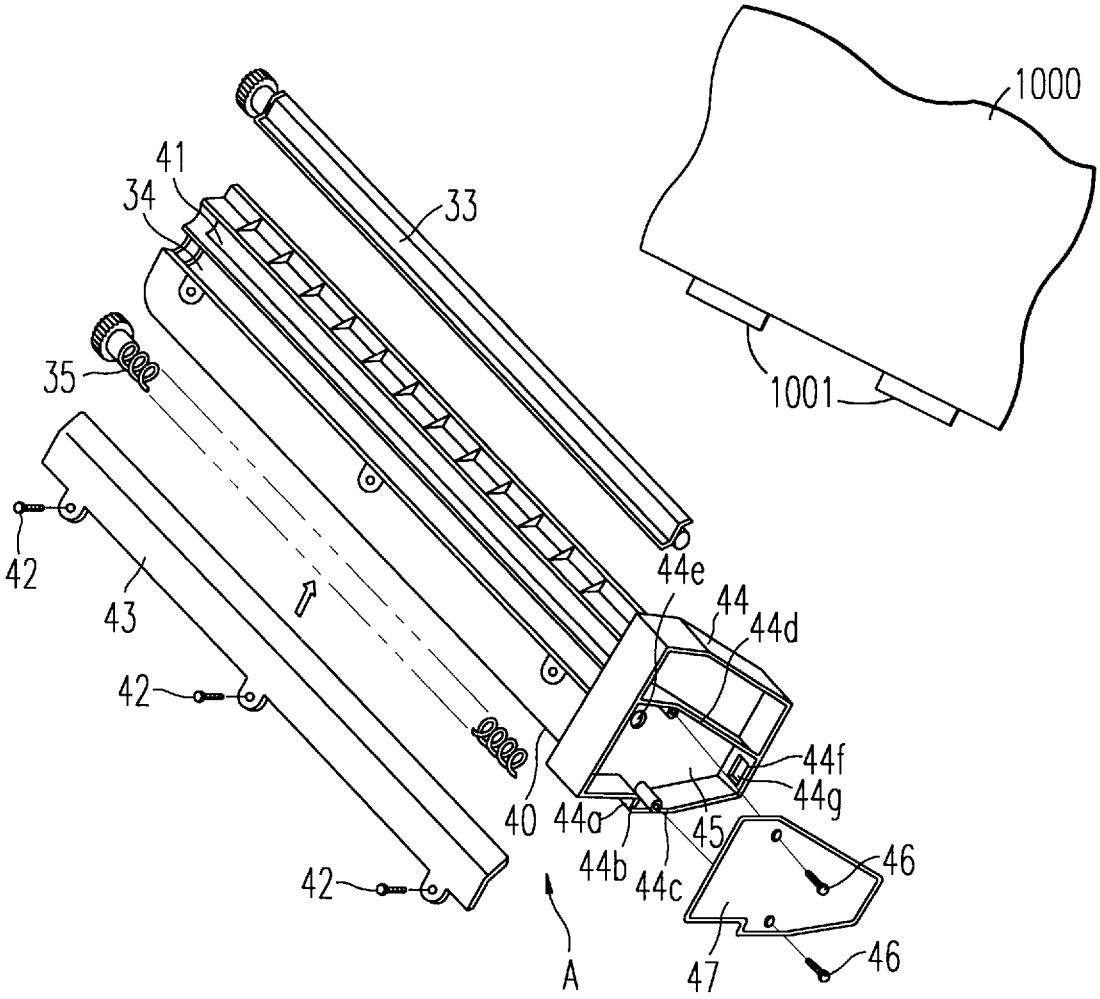
FIG. 4 is a perspective exploded view of a mechanism and frame for conveying and combining new and used toner according to the present invention.

FIG. 4 shows the photosensitive unit A in more detail. As shown, the toner recovery tank 34 hosts a screw 35 which is configured to rotate therein so as to convey the used toner laterally toward a frame 44. A wing receiving part 41 is connected to the toner recovery tank 34 and receives the toner floating wing 33, which rotates therein. An upper cover 43 attaches to the case 40 by way of screws 42 so as to cover the screw 35 and partially cover the floating wing 33. The screw 35 and the floating wing 33 are rotatably driven by a driving source, not shown.

The frame 44 is disposed at one end of the case 40 and is positioned proximate a front of the copier device so as to be easily accessed by a user. A tier 44*a* formed in the frame 44 includes a new toner supplying orifice 44*b* (also discussed with respect to FIG. 5), and a toner guiding wall 44*c* which is formed at an incline relative to a horizontal line that is tangential to a bottom 44*f* of the frame 44. An opposing guiding wall 44*d* also inclines, but in an opposite direction of the wall 44*c*, and perhaps at a different angle, as will be discussed with respect to FIG. 5. A used toner orifice 44*e* is formed through the frame 44 so as to receive used toner therethrough as provided by the toner recovery tank 34. At the bottom of the frame 44, a toner discharging orifice 44*g* is formed through the frame and is placed at the base of the walls 44*c* and 44*d*. The walls 44*c* and 44*d* slant downward toward the toner discharging orifice 44*g*, although in opposing directions. The frame 44 and the subcomponents of the frame 44 (i.e., elements 44*a*, 44*b*, 44*c*, 44*d*, 44*e*, 44*f*, and 44*g*) form a conveyance path 45 for guiding, and automatically mixing, the new toner and the used toner as the mixed toner is delivered to the developer 12. No active, driven parts are required in the frame 44, because both the new and used toner are conveyed in the frame as a result of gravity. A side cover 47 is connected to the frame 44 by screws 46 so as to cover the conveyance path 45.

To insert/remove the photosensitive unit A into/from the copier, the user opens a front door 1000, which rotates on a hinge 1001 that is attached to a copier frame (not shown). Once the front door 1000 is opened, the user may insert/remove the unit A with the conveyance path 45 pointing toward the user. The new toner bottle 25 (FIG. 3) may similarly be replaced, with or without also removing the unit A.

Figure 5:
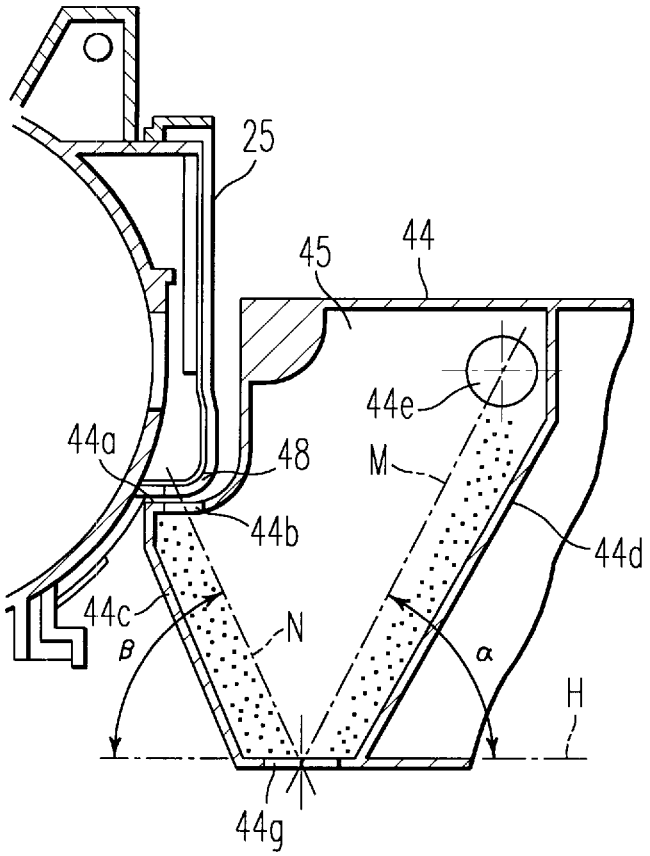
FIG. 5 is a side view of the frame that conveys and combines new and used toner according to the present invention as well as a coupling of a new toner tank to the frame.

FIG. 5 shows how the new toner from the new toner tank 25 enters the frame 44 so as to automatically mix in a predetermined proportion with used toner from the toner recovery tank 34 (FIG. 4) while being conveyed to the developer 12 (FIG. 3). The new toner tank 25 has a new toner discharging orifice 48 formed therein such that when the new toner tank 25 is placed on the tier 44*a* of the frame 44, the new toner discharging orifice 48 aligns with the new toner supplying orifice 44*b*. Because the new toner discharging orifice 48 is located at a position higher than the new toner supplying orifice 44*b*, as is evident from the relative positions of the new toner tank 25 and frame 44 with respect to a horizontal line H in FIG. 5, new toner falls from the new toner tank 25 into the conveyance path 45 via the new toner supply orifice 44*b*. Subsequently the new toner is guided by the toner guiding wall 44*c* at a predetermined angle β, with respect to the horizontal line H, toward the toner discharging orifice 44*g* as a result of a gravitation force acting on the new toner. The new toner will tend to remain in a stream that is generally bounded by the toner guiding wall 44*c* and a line N that extends between a center of the new toner supplying orifice 44*b* and a center of the toner discharging orifice 44*g*. The new toner supplying orifice 44*c* includes a portion that is generally parallel with the line N, and thus is also inclined at the predetermined angle β.

The predetermined angle β is shown to be about 65°. However, this angle may be set within a broad range under the considerations that the minimum angle is sufficiently steep to allow a sufficient amount of the toner to smoothly slide along the wall 44*c* to the orifice 44*g*, and the maximum angle allows an orderly combination and mixing of the used toner with the new toner at the orifice 44*g*. Furthermore, as will be discussed below, the predetermined angle β will be less than another predetermined angle α (shown to be about 71°, although also suitably adjustable to other angles consistent with the desired flow rate and flow characteristics of the used toner) associated with the other guide wall 44*d* that guides the used toner to the orifice 44*g*. As the new and used toner mix when passing through the orifice 44*g*, the combined toner is conveyed to the developing device 12 via a receiving orifice (not shown) formed in the developing device 12.

Figure 6:
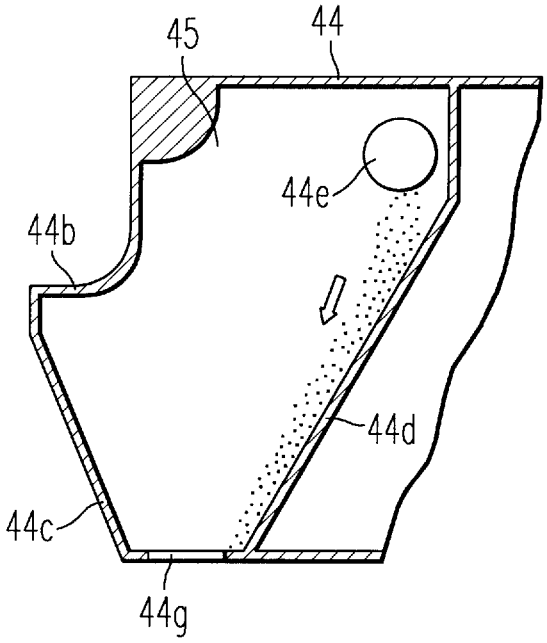
FIG. 6 is a side view of the frame according to the present invention and shows how used toner is guided by the frame from a used toner orifice to a toner discharging orifice.

FIG. 6 will be used to discuss how the used toner is guided to the orifice 44*g* via the conveyance path 45. The used toner is provided through the toner recovered orifice 44*e*, via the screw 35. This used toner falls down onto the inclined surface of the other toner guiding wall 44*d* as a result of gravitational force. Because the slope of the wall 44*d* is set at the predetermined angle α, which is sufficiently steep to cause the used toner to slide thereon, the used toner slides toward the orifice 44*g*. By sliding down the wall 44*d* in an orderly fashion as shown in FIG. 6, the used toner and new toner mix in relatively consistent proportions as they enter the orifice 44*g*. Consequently, the image quality of the copies made by the image forming device is relatively consistent because the relative ratios of new toner to used toner does not vary substantially when the copier operates in a steady state condition.

Returning to FIG. 5, the predetermined angle a is set such that the all of the used toner conveyed by the screw 35 (FIG. 4) is passed through the used toner orifice 44*e* as the used toner becomes available. Alternatively, a portion of the used toner may be withheld from entering the used toner orifice 44*e* if the ratio of used toner to new toner is desired to be lowered. On the other hand, new toner from the new toner tank 25 will tend to backup along the guiding wall 44*c*,as long as the a sufficient supply remains in the new toner tank 25. To this end, if for some reason the flow of used toner into the orifice 44*e* is interrupted, the supply of toner to the developing device 12 will be accommodated exclusively from the new toner.

As shown in FIG. 5, a line M extending between a center of the toner recovery orifice 44*e* and a center of the toner discharging orifice 44*g* is set at the predetermined angle α, and the guiding wall 44*d* has a portion which is generally parallel to the line M. As previously discussed, the used toner exhibits a degraded flow capacity as compared with new toner. Consequently, to ensure an adequate mixing of used toner with new toner the predetermined angles α and β comply with relationship, $$\alpha > \beta, \text{ where}$$

the angles α and β may be adjusted so as to control the relative proportions by which the new and used toner enter the developing device 12. Alternatively, one or both of the walls 44*c* and 44*d* include segments that have different coefficients of friction which vary the rate and flow characteristics of the new and used toner as they are guided down the walls 44*c* and 44*d* respectively.

Regarding the maintenance, manufacturability, and ease of repair of the present copier having the toner recycling feature, because the unit A serves both as a case, and a host for the conveyance path 45, separate components for handling the conveyance of the new toner and used toner are not required. Furthermore, the removal of the entire unit A is readily accomplished by withdrawing the unit A when the front door 1001 (FIG. 4) is opened. Likewise, when the front door 1001 is opened, a spent new toner tank 25 may be replaced with a new toner tank 25 without having to move the toner recycling portion of the copier and without incurring the expense of replacing any of the components that perform the toner recycling portion. By combining these discrete components as has been presently described, a minimum number of active components (e.g., components requiring a mechanical driving device such as a motor) are required, thereby lowering cost and improving reliability relative to conventional apparatuses having a toner recycling feature.

Obviously, numerous (additional) modifications and variations of the present invention are possible in light of the above teachings. It is therefore to be understood that within the scope of the appended claims, the invention may be practiced otherwise than as specifically described herein.

What is claimed as new and is desired to be secured by Letters Patent of the United States is:

1. An electrophotographic apparatus configured to recycle toner therein, comprising:

a photosensitive body configured to move along a predetermined path and configured to hold a latent image thereon;

a developing means for developing the electrical latent image with a toner comprising used toner so as to form a toner image, said developing means having a developer inlet for receiving said used toner;

transferring means for transferring the toner image from the photosensitive body to a sheet, where a portion of said toner remains as the used toner on said photosensitive body after said toner image is transferred to said sheet;

cleaning means for removing the used toner from the photosensitive body;

a toner recovery tank configured to collect used toner from the cleaning means, said toner recovery tank having a toner recovery tank outlet through which the used toner is dispensed therefrom;

a frame having a frame inlet at an upper portion thereof and a frame outlet formed in a lower portion thereof, said frame outlet being coupled to the developer inlet of said developing means, said frame comprising a conveyance path that is arranged to convey said used toner from said toner recovery tank outlet of said toner recovery tank to said developer inlet; and feeding means for feeding the used toner from the toner recovery tank in a horizontal direction to the frame inlet positioned at a side of the feeding means, wherein said frame inlet being disposed at a higher position than the frame outlet so that said used toner is conveyed by gravity to said developing means via said frame.

2. An electrophotographic apparatus in accordance with claim 1, further comprising:

a new toner tank configured to dispense new toner held therein to the developing means via said frame, said new toner tank having a new toner tank outlet formed therein through which the new toner is discharged, wherein said frame further comprises another frame inlet coupled at said upper portion thereof to said new toner tank outlet so as to receive said new toner and convey said new toner to said developer inlet.

3. An electrophotographic apparatus in accordance with claim 2, wherein:

said conveyance path being configured to guide said used toner toward said developer inlet along a used toner path, which includes a portion that is inclined at a first angle as measured between a horizontal line at said developer inlet and a first angled line between said toner recovery tank outlet and said developer inlet;

said conveyance path being configured to guide said new toner toward said developer inlet along a new toner path which includes a portion that is inclined at a second angle measured between the horizontal line and a second angled line between said new toner tank outlet and said developer inlet; and said first angle being larger than said second angle.

4. An electrophotographic apparatus in accordance with claim 3, wherein said conveyance path comprises:

a first guiding wall configured to guide the used toner from said toner recovery tank outlet to said developer inlet; and a second guiding wall configured to guide the new toner from said new toner tank outlet to said developer inlet.

5. An electrophotographic apparatus in accordance with claim 4, wherein at least a part of surface of said first guiding wall comprises a material having a lower coefficient of friction than said second guiding wall.

6. An electrophotographic apparatus in accordance with claim 2, wherein said conveyance path comprises:

a first guiding wall configured to guide the used toner from said toner recovery tank outlet to said developer inlet along an inclined path that slopes downward at a predetermined angle; and a second guiding wall configured to guide the new toner from said new toner tank outlet to said developer inlet along another inclined path that slopes downward at another predetermined angle having a value that is less than the predetermined angle of said first guiding wall.

7. An electrophotographic apparatus in accordance with claim 6, wherein at least a part of a surface of said first guiding wall comprises a material having a lower coefficient of friction than said second guiding wall.

8. The apparatus of claim 2, further comprising a unit case that interconnects said frame, said photosensitive body and said cleaning means.

9. An electrophotographic apparatus in accordance with claim 1, further comprising:

a front door having a backside;

a hinge connected to said front door, about which said front door is rotatable between an open position and a closed position, wherein when said front door is in said open position, said frame is configured to be inserted therein with the conveyance path facing said backside of said front door when said front door is placed in said closed position.

10. A method for conveying toner in an electrophotographic apparatus, comprising the steps of:

moving a photosensitive body along a predetermined path;

forming a latent image on said photosensitive body with an optical beam;

developing the latent image with toner from a developer and forming a toner image on the photosensitive body;

transferring the toner image from the photosensitive body to a sheet, where a portion of said toner remains as used toner on said photosensitive body after said toner image is transferred to said sheet;

removing the used toner from the photosensitive body;

collecting the used toner in a toner recovery tank and dispensing the used toner therefrom via a toner recovery tank outlet formed in the toner recover tank; and conveying horizontally said used toner from the toner recovery tank outlet to a frame inlet of an adjacent frame and conveying said used toner in a conveyance path in said frame from said toner recovery tank to said developer through the conveyance path as a result of a gravitational force being exerted on said used toner.

11. The method of claim 10, further comprising the steps of:

dispensing new toner from a new toner tank via a new toner tank outlet formed therein;

coupling another frame inlet formed in an upper portion of said frame to said new toner tank outlet so as to receive said new toner in said frame; and conveying said new toner to said developer via said frame.

12. The method of claim 11, wherein:

said step of conveying said used toner comprises guiding said used toner toward said developer inlet along a used toner path defined by a first angle between a horizontal line at said developer inlet and a first angled line between said toner recovery tank outlet and said developer inlet; and said step of conveying said new toner comprises guiding said new toner toward said developer inlet along a new toner path defined by a second angle between the horizontal line and a second angled line between said new toner tank outlet and said developer inlet, wherein said first angle is larger than said second angle.

13. An electrophotographic apparatus configured to recycle toner, comprising:

a photosensitive body configured to move along a predetermined path and configured to hold a latent image thereon;

a developer positioned at a periphery of said photosensitive body, said developer comprising, a developer inlet formed in an upper portion thereof configured to receive toner that falls therethrough, and a toner applicator configured to apply said toner from within said developer to the electrical latent image on said photosensitive body so as to form a toner image on said photosensitive body;

a transfer mechanism positioned at the periphery of said photosensitive body, at a location that is downstream of said developer, where downstream refers to a direction of movement of said photosensitive body along the predetermined path, said transfer mechanism comprising a belt configured to carry a sheet thereon and bring said sheet into contact with said toner image so as to transfer said toner image to said sheet, where a portion of said toner remains as used toner on said photosensitive body after said toner image is transferred to said sheet;

a cleaning member positioned at the periphery of said photosensitive body, at a location that is downstream of said transfer mechanism, and in contact with said photosensitive body so as to remove the used toner from the photosensitive body;

a toner recovery tank configured to collect [a] the used toner from the cleaning member, said toner recovery tank having a toner recovery tank outlet;

a toner feeding mechanism configured to horizontally feed the used toner through said toner recovery tank outlet; and a frame positioned at a side of said toner feeding mechanism and having a frame inlet formed at an upper portion thereof and having a frame outlet at a lower end thereof that is coupled to the developer inlet of a developer, said frame further comprising a conveyance path connecting said frame inlet to said developer inlet, wherein said toner recovery tank outlet being disposed at a higher position than the frame outlet and the developer inlet such that said used toner from said toner recovery tank is conveyed via gravity to said developer through the conveyance path without requiring assistance from a device that actively urges said used.

14. An electrophotographic apparatus in accordance with claim 13, further comprising:

a new toner tank configured to dispense new toner held therein to the developer through a new toner tank outlet formed in the new toner tank, wherein at least a portion of said frame being positioned under said new toner tank outlet so as to receive said new toner as a result of a gravitational force exerted on said new toner, and said conveyance path of said frame being configured to guide said new toner toward said developer inlet such that said new toner and said used toner are mixed when entering said developer through said developer inlet.

15. An electrophotographic apparatus in accordance with claim 14, wherein:

said conveyance path comprises a first guide wall disposed under said toner recovery tank outlet and angled at a first predetermined angle so as to guide said used toner toward said developer inlet, wherein said first predetermined angle is measured between a horizontal line at said developer inlet and a first angled line between said toner recovery tank outlet and said developer inlet;

said conveyance path comprises a second guide wall disposed under said new toner tank outlet and angled at a second predetermined angle so as to guide said new toner toward said developer inlet, wherein said second predetermined angle is measured between the horizontal line and a second angled line between said new toner tank outlet and said developer inlet; and said first predetermined angle being larger than said second predetermined angle.

16. An electrophotographic apparatus in accordance with claim 14 wherein said frame comprises:

a first guide wall that is positioned under said toner recovery tank outlet so as to guide the used toner from said toner recovery tank outlet to said developer inlet; and a second guide wall that is positioned under said new toner tank outlet so as to guide the new toner from said new toner tank outlet to said developer inlet, wherein said first guide wall is angled at a first predetermined angle with respect to a horizontal line extending from said developer inlet, said second guide wall is angled at a second predetermined angle with respect to the horizontal line, and said first predetermined angle is greater than said second predetermined angle.

17. An electrophotographic apparatus in accordance with claim 16, wherein at least a part of a surface of said first guide wall comprises a material having a lower coefficient of friction than said second guide wall.

18. An electrophotographic apparatus in accordance with claim 16, wherein a toner bearing surface of said first guide wall comprises a material having a lower coefficient of friction than said second guide wall.

19. An electrophotographic apparatus in accordance with claim 14, wherein the new toner tank is configured to be removed separate from the frame.

20. An electrophotographic apparatus in accordance with claim 13, further comprising:

a front door having a backside;

a hinge connected to said front door, about which said front door is rotatable between an open position and a closed position, wherein when said front door is in said open position, said frame is configured to be inserted therein with the conveyance path facing said backside of said front door when said front door is placed in said closed position.

21. An electrophotographic apparatus in accordance with claim 13, further comprising a unit case that interconnects said photosensitive body, said frame, and said cleaning member.

* * * * *